US009248954B2

(12) United States Patent
Doglioni Majer

(10) Patent No.: US 9,248,954 B2
(45) Date of Patent: Feb. 2, 2016

(54) PRESSURE BEVERAGE CARTRIDGE AND PREPARATION METHOD

(75) Inventor: Luca Doglioni Majer, Carate Urio (IT)

(73) Assignee: TUTTOESPRESSO S.R.L., Milan (IT)

( * ) Notice: Subject to any disclaimer, the term of this patent is extended or adjusted under 35 U.S.C. 154(b) by 1266 days.

(21) Appl. No.: 12/092,283

(22) PCT Filed: Dec. 4, 2006

(86) PCT No.: PCT/IB2006/003462

§ 371 (c)(1),
(2), (4) Date: Jun. 18, 2008

(87) PCT Pub. No.: WO2007/063411

PCT Pub. Date: Jun. 7, 2007

(65) Prior Publication Data

US 2008/0264267 A1 Oct. 30, 2008

(30) Foreign Application Priority Data

Dec. 2, 2005 (EP) ..... 05026318

(51) Int. Cl.
*A47J 31/06* (2006.01)
*B65D 85/804* (2006.01)

(52) U.S. Cl.
CPC ..... *B65D 85/8043* (2013.01)

(58) Field of Classification Search
CPC ... B65D 85/8043; B65D 85/804; A47J 31/44; A47J 31/40; A47J 31/4471; A47J 31/4467; A47J 31/4464; A47J 31/446; A47J 31/0673; A47J 31/368; A47J 31/407; A47J 31/22; A47J 31/0657; A47J 31/0668; A47J 31/3695
USPC ..... 99/349, 494, 421 V, 416, 418, 415, 419, 99/431, 275–323.2; 119/329, 459, 460; 210/282, 314, 323.1; 206/0.5; 426/77, 426/112, 115, 82
See application file for complete search history.

(56) References Cited

U.S. PATENT DOCUMENTS

| | | | | |
|---|---|---|---|---|
| 4,846,052 | A * | 7/1989 | Favre et al. | 99/295 |
| 4,853,234 | A * | 8/1989 | Bentley et al. | 426/77 |
| 5,008,013 | A * | 4/1991 | Favre et al. | 210/482 |
| 5,402,707 | A * | 4/1995 | Fond et al. | 99/295 |
| 5,649,472 | A * | 7/1997 | Fond et al. | 99/295 |
| 5,897,899 | A * | 4/1999 | Fond | 426/112 |
| 6,026,732 | A * | 2/2000 | Kollep et al. | 99/295 |
| 6,763,759 | B2 * | 7/2004 | Denisart | 99/302 P |
| 6,777,007 | B2 * | 8/2004 | Cai | 426/78 |
| 6,786,134 | B2 * | 9/2004 | Green | 99/289 P |
| 6,786,135 | B1 * | 9/2004 | Hsu | 99/293 |
| 6,786,136 | B2 * | 9/2004 | Cirigliano et al. | 99/323 |
| 6,832,542 | B2 * | 12/2004 | Hu et al. | 99/302 R |
| 6,849,285 | B2 * | 2/2005 | Masek et al. | 426/112 |
| 7,685,932 | B2 * | 3/2010 | Rahn et al. | 99/315 |
| 8,033,420 | B2 * | 10/2011 | Roseblade et al. | 220/731 |

(Continued)

FOREIGN PATENT DOCUMENTS

| | | | |
|---|---|---|---|
| EP | 1557373 | A | 7/2005 |
| WO | 2005066040 | A | 7/2005 |

*Primary Examiner* — Hung D Nguyen
(74) *Attorney, Agent, or Firm* — Oblon, McClelland, Maier & Neustadt, L.L.P.

(57) ABSTRACT

A cartridge for beverage dispensing machine is provided with outlet means (9B, 14) that are opened by the combined action of a mechanical compression and internal pressurization of the cartridge.

25 Claims, 8 Drawing Sheets

(56) References Cited

U.S. PATENT DOCUMENTS

| | | | | |
|---|---|---|---|---|
| 8,047,126 | B2 * | 11/2011 | Doglioni Majer | 99/295 |
| 2002/0015768 | A1 * | 2/2002 | Masek et al. | 426/115 |
| 2003/0116029 | A1 * | 6/2003 | Kollep | 99/279 |
| 2004/0079237 | A1 * | 4/2004 | Denisart | 99/275 |
| 2004/0173102 | A1 * | 9/2004 | Halliday et al. | 99/295 |
| 2004/0177764 | A1 * | 9/2004 | Halliday et al. | 99/295 |
| 2004/0191371 | A1 * | 9/2004 | Halliday et al. | 426/112 |
| 2004/0197444 | A1 * | 10/2004 | Halliday et al. | 426/112 |
| 2004/0206245 | A1 * | 10/2004 | Halliday et al. | 99/337 |
| 2004/0241307 | A1 * | 12/2004 | Knitel | 426/594 |
| 2005/0011364 | A1 * | 1/2005 | Chen et al. | 99/275 |
| 2005/0034604 | A1 * | 2/2005 | Halliday et al. | 99/279 |
| 2005/0103204 | A1 * | 5/2005 | Halliday et al. | 99/295 |
| 2005/0120884 | A1 * | 6/2005 | Kerner | 99/275 |
| 2005/0279215 | A1 * | 12/2005 | Cai | 99/279 |
| 2005/0279219 | A1 * | 12/2005 | Turi | 99/286 |
| 2006/0011066 | A1 * | 1/2006 | Bunn et al. | 99/279 |
| 2006/0107841 | A1 * | 5/2006 | Schifferle | 99/279 |
| 2006/0130664 | A1 * | 6/2006 | Majer Doglioni | 99/275 |
| 2006/0137533 | A1 * | 6/2006 | Wise | 99/279 |
| 2006/0174769 | A1 * | 8/2006 | Favre et al. | 99/275 |
| 2006/0191420 | A1 * | 8/2006 | Mazzola et al. | 99/287 |
| 2006/0219098 | A1 * | 10/2006 | Mandralis et al. | 99/279 |
| 2006/0236871 | A1 * | 10/2006 | Ternite et al. | 99/295 |
| 2006/0288873 | A1 * | 12/2006 | Yang | 99/279 |
| 2007/0062375 | A1 * | 3/2007 | Liverani et al. | 99/279 |
| 2007/0144355 | A1 * | 6/2007 | Denisart et al. | 99/275 |
| 2008/0156196 | A1 | 7/2008 | Doglioni Majer | |
| 2011/0005399 | A1 * | 1/2011 | Epars et al. | 99/295 |

* cited by examiner

PRESSURE BEVERAGE CARTRIDGE AND PREPARATION METHOD

BACKGROUND

The present invention relates to a cartridge and a method for preparing hot and cold beverages. The invention also concerns a method for dispensing said beverages.

There are two basic ways of preparing a coffee with a dispensing machine: by loading the loose ingredients, such as coffee beans or soluble ingredients, in the machine, in bulk form, ready to be dosed and in some cases (such as used coffee grounds) eventually disposed of, or by making use of a cartridge, i.e. a capsule or a pod, containing a preset amount of product. The product in the cartridge can be e.g. ground coffee or a leaf product, or a soluble ingredient, such as chocolate or cappuccino pre-mix.

The use of a cartridge has the advantage of sealing within the cartridge a coffee preparation (i.e. a ground or soluble product) in its best condition, with the maximum of its flavor and aroma being trapped in the cartridge or cartridge container.

A problem with cartridges is that of producing a good amount of cream.

Another problem is related to self-sealed cartridges. These cartridges are provided with sealing means to seal them without making use of a separate container. The sealing means have to effectively seal the cartridge content from air oxidation and at the same time they should be easily opened when the cartridge has to be used.

A further, constant problem, especially with those cartridges containing a ground or leaf product, is that of improving the brewing conditions so as to obtain the best possible beverage. This is particularly important with coffee. WO02/076270 discloses a system for the preparation of a beverage from a product contained in a disposable cartridge in combination with a collecting device having beverage collecting means designed to contain the cartridge, wherein at least one throttling arrangement is provided at the exit of the capsule to provide a controlled flow of beverage leaving the cartridge.

Although this system ensures superior mixing quality of the beverage, it is not very flexible.

WO2004/030499 in the name of the present Applicant, discloses an, apparatus and a method for the preparation of a beverage according to which a plunger perforates the bottom wall of the cartridge through an outlet opening and generates in correspondence to said opening a throttling element having specific dimensions that result in delivering the beverage product for at least 75% of the total dispensing time.

This capsule, as well as the previously mentioned ones, has the drawback of requiring a plunger, i.e. a perforating member to open the outlet opening in the bottom wall of the capsule.

In EP-A-1555218, the bottom wall of the capsule is provided with an area where the thickness is less than that of the remaining bottom wall; within this area a plurality of grooves are located: once the pressure inside the capsule has reached a sufficient value the thinner portion of the bottom wall breaks open along the grooves to provide outlet means for the beverage.

This embodiment has the drawback that the thinner portion including the grooves cannot guarantee a consistently reliable sealing of the capsule because the thinner portion and the weakening grooves can easily be partly broken when accidentally compressed.

Therefore, there is the need for an improved cartridge and for an improved method for preparing dispensing beverages in an easy, reliable, cost-effective way.

BRIEF SUMMARY

It is an aim of the present invention to solve the above mentioned problems and provide an improved beverage dispensing cartridge and method that can give excellent beverage from one or more ingredients.

This aim is achieved by the present invention that provides a cartridge for a beverage dispensing apparatus.

The present invention also provides a method of preparing a beverage in a beverage dispensing cartridge.

According to the invention, the cartridge for a beverage dispensing apparatus has water inlet means for feeding water to said cartridge to prepare said beverage and build up pressure within said cartridge, and beverage outlet means for discharging said beverage from said cartridge, wherein said outlet means can withstand a mechanical deformation towards the interior of the cartridge as applied to the cartridge by compression once it has been placed in the apparatus and is in the dispensing step before hot water feeding. The outlet means are first deformed and then broken open after feeding water to the cartridge, by the combined action of said mechanical deformation and the force of the pressure built up within said cartridge.

This results in the capsule being held closed and under hot water pressure for a length of time that can be of a few seconds, e.g. three or more seconds, before they are opened by the inner pressure. Thanks to this the beverage quality is dramatically improved.

In a preferred embodiment, the outlet means are portions of the bottom wall of the cartridge defined by grooves. The grooves are thick enough to withstand the compression deformation force and will break upon the additional application of the force generated by the internal pressure.

To apply the forces on the outlets, these are preferably provided with protruding portions that protrude from the bottom wall so that the bottom wall of the capsule is supported by those protruding portions when the cartridge is placed in an external element, such as a beverage collecting unit, i.e. a unit that collects the beverage coming from the opened cartridge.

Alternatively, the protruding parts can be located on and be integral with the collecting unit. However, it is preferred to have the protruding portions integral with the outlets of the cartridge.

The collecting element is provided with a perforated portion of the bottom wall of the cartridge, to compress and deform the same toward the inside of the cartridge. The force applied by the external element is not sufficient per se to open the outlet means by breaking the bottom wall along the above mentioned grooves, which can withstand this mechanical deformation of the bottom towards the interior of the cartridge.

When the cartridge is pressurized by feeding pressurized water to it, the pressure inside the cartridge is only counterbalanced by the reaction force exerted by the external element at the bottom wall portions supported on the protrusions by the beverage collecting element. Where the wall bottom does not contact the collecting unit, a cut force is generated which results in the breakage of the bottom wall along said outlet grooves, i.e. in the opening of the cartridge outlet means.

In other words, when a pressure build-up is achieved within the cartridge, the portions of the cartridge bottom wall not supported by the collecting unit housing the cartridge are biased toward the outside of the cartridge, while the portions of the bottom wall supported by the collecting unit or external, element (and already biased by the same element toward the inside) resist said deformation, this promoting breakage of the wall along the grooves there provided.

According to another aspect of the invention, there is provided a method of dispensing a beverage characterized in feeding said beverage to said outlet means through at least one passage located within said cartridge between said beverage preparing chamber and said outlet means and in temporarily and at least partially blocking said at least one passage by means of a blocking element, until a pressure sufficient to deform and/or break said blocking element is reached within said cartridge, whereby said beverage flows through said passage to said outlet means.

For the purposes of this invention, a "passage" means any space within the brewing or dissolving chamber and the outlet means of the cartridge through which the beverage flows. According to a preferred embodiment the passage is defined by the bottom wall of the cartridge and an area without holes of the filter support, the blocking element being a wall extending between said bottom wall and said filter support full area. The blocking wall can be deformed to open the passage in one or more points and is located between the filter support area with holes and the outlet means, i.e. along the flow path of the beverage.

The beverage dispensing system according to the present invention results in a number of advantages.

A first advantage is in the improved sealing of the cartridge. Because the outlet discharge openings are opened by the combined use of pressure and mechanical compression, with a plunger, they can be thick enough to provide the required sealing of the bottom of the capsule, contrary to known art, where they had to be provided with thin fracture lines to ensure their opening under pressure.

A further advantage is that the cream quality is improved by the use of the invention cartridge.

Another advantage is, inter alia, that the brewing time, i.e. the time for preparing the beverage, is extended and increased with respect to the time required according to known methods, ceteris paribus. Such extended time provides a better extraction from the ground coffee (or leaves) and a better dissolution of the soluble products, this resulting in a better final beverage.

Moreover the cartridge according to the present invention allows for preparing a beverage having better organoleptic characteristics with respect to the beverage which can be obtained with traditional cartridges under same conditions.

BRIEF DESCRIPTION OF THE DRAWINGS

Further characteristics and advantages of the present invention will be more evident from the following description, given as a non limiting example with reference to the attached drawings, wherein.

DETAILED DESCRIPTION

Figure 1:
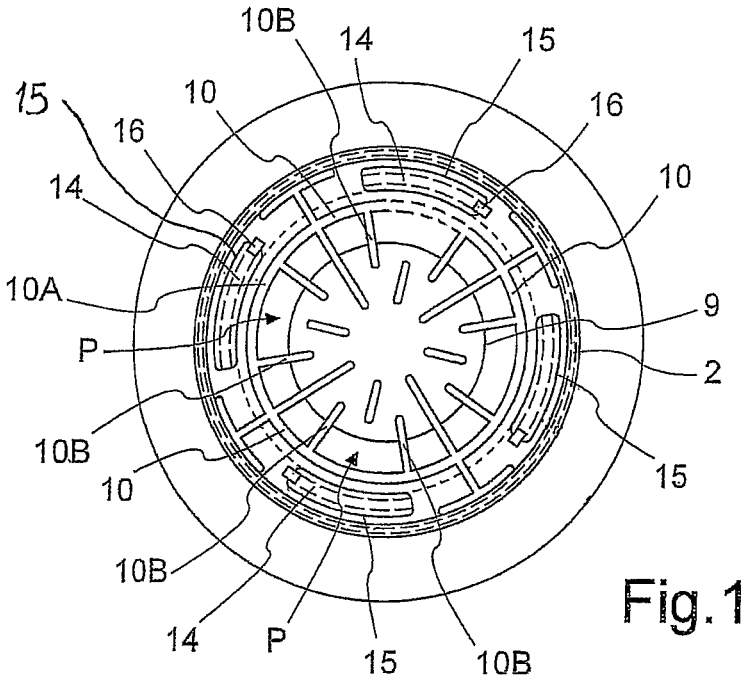
FIG. 1 is a top view of the inside of the capsule.

With reference to the drawings, cartridge 1 comprises a lower portion 2 and a top portion 3 that are secured together by any suitable way, e.g. glued, thermally welded etcetera, to provide a container for the beverage product. Top portion 3 is shown provided with a sealing foil 4 that will be punctured by pointed elements 5, i.e. by a plurality of puncturing means, upon feeding water from a pump: this embodiment is disclosed in co-pending application n. PCT/IT2004/000503 filed 17.09.2004 in the name of "Tuttoespresso". The invention scope is not limited to the shown embodiment; other known embodiments, e.g. such as the presence of holes or the use of puncturing means not carried by the cartridge, can be used in the present invention and are within the scope of protection of this application. As a matter of fact, also cartridges that are not of the self-sealed type, e.g. those cartridges that have a top portion 3 provided with a plurality of holes and are packaged in a separate, sealed, container, are within the present invention scope of protection, provided they have the claimed internal pressure build-up means in the form of the sealed outlets hereinafter discussed.

Figure 2:
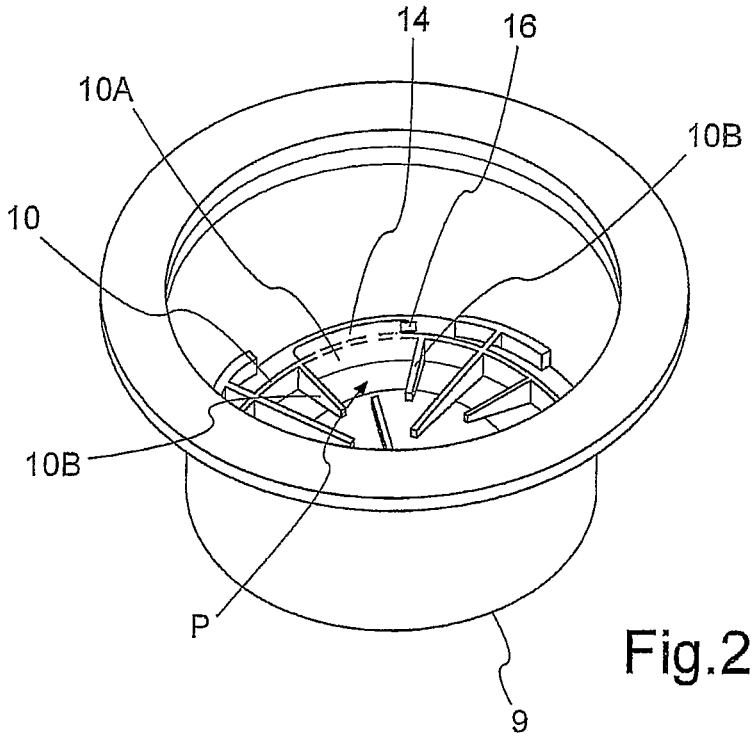
FIG. 2 is an enlarged perspective view of the capsule portion of FIG. 1.
Figure 3:
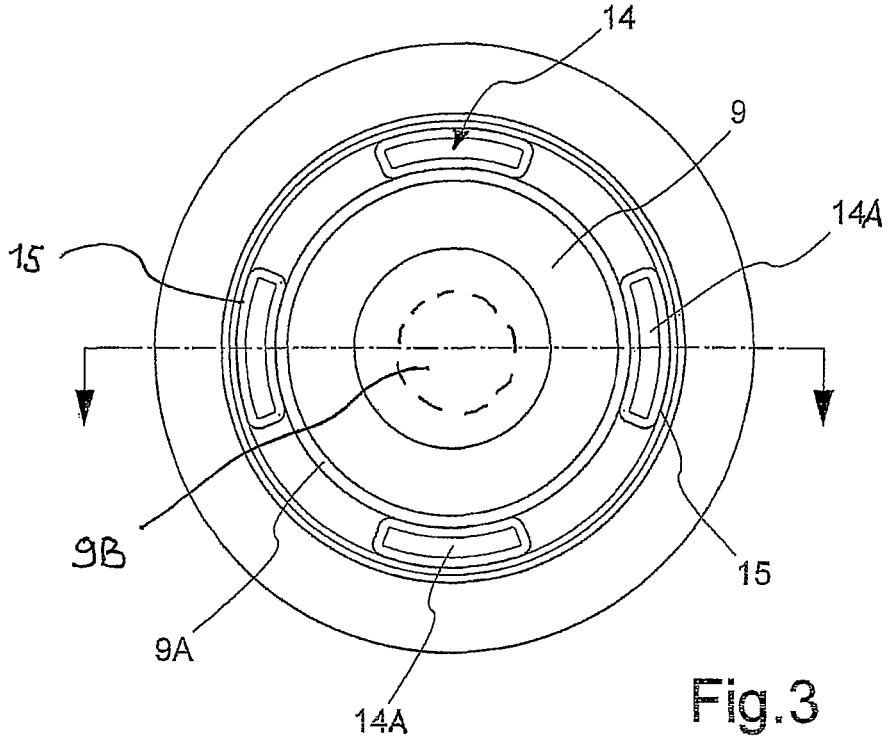
FIG. 3 is a view from the bottom of the capsule of FIG. 1.
Figure 4:
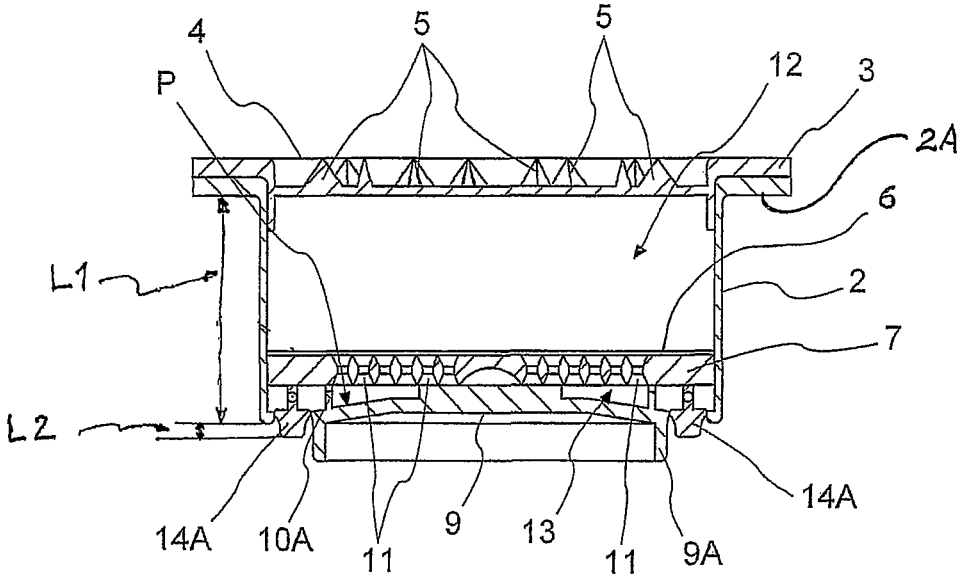
FIGS. 4-6 are views along different longitudinal section planes of the invention capsule of FIGS. 1 to 3.
Figure 5:
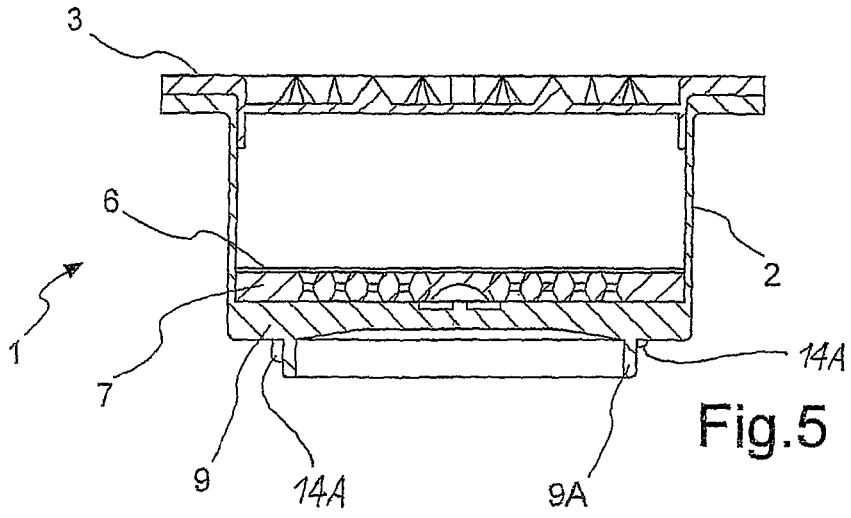
Figure 6:
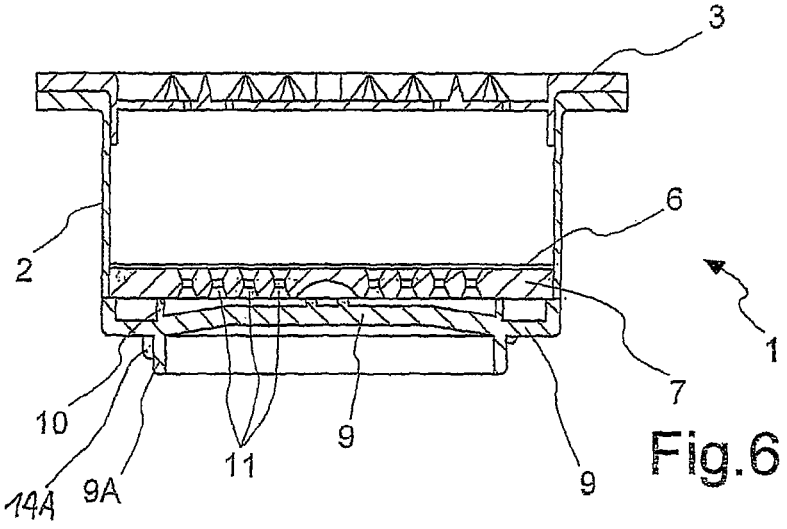

FIGS. 4-6 also show a filter 6 and a filter supporting element 7 that are inserted into the lower portion 2 of the cartridge 1 and are positioned on a plurality of ridges upwardly projecting from bottom wall 9 of cartridge 1. These ridges are better detailed in FIG. 1 and FIG. 2.

The bottom wall 9 is internally provided with a ridge in the form of a circular wall 10 that extends substantially vertically upwards and that (FIGS. 4 and 6) abuts to the filter supporting element 7. A circular wall 10 provided with a plurality of openings or missing portions can be used.

In the shown embodiment, wall 10 has deformable portions that become openings when water is fed to the cartridge. The shown filter support 7 is provided with a plurality of holes 11 that are located only within the portion defined by circular wall 10 and that are not present in the central area of the filter. Thus the beverage preparation chamber 12, defined by top portion 3 and filter supporting element 7 is connected by holes 11 to a pressure chamber 13 defined by filter supporting element 7, circular wall 10 and bottom wall 9. When water is fed to preparation chamber 12 it mixes with the preparation product therein contained and the resulting beverage flows through holes 11 to pressure chamber 13.

According to one aspect of the invention, there is provided at least one passage P that connects the beverage preparing chamber 12 with beverage outlet means 14. In the shown embodiment such passages are defined by internal ridges or walls 10B that extend vertically from the bottom wall 9 to filter support 7 to canalize the beverage flow to the circular wall 10. Passage P is provided with a blocking means to temporarily prevent the resulting beverage from flowing from chamber 12 through chamber 13 to the cartridge outlet discharge means 14 before a sufficient internal pressure is achieved.

In other words the blocking means acts as pressure build-up means and, once a sufficient pressure is reached within the cartridge, the blocking means deforms and/or collapses to permit the beverage flow toward the outlet openings through passage P.

In the shown embodiment, the blocking means is portion 10A of circular wall 10 that extends between walls 10B and that is deformable, usually plastically deformable, or collapsable, once the pressure in pressure chamber 13 has reached a sufficient value (e.g. from 3 to 20 bar). When the wall portions 10A are deformed and partially flattened, the beverage will flow through the passage P to the area outside circular wall 10, between wall 10 and the wall of the lower portion 2 of the cartridge.

In other words, the wall portions 10A temporarily obstruct the passages P to the cartridge outlet means. Once the temporary blocking means 10A has been deformed by the pressurized beverage present in chamber 13, it results in a throttling element defined by the opened passage P that let the beverage flow to outlet means 14. The presence of a throttling means is of further benefice to the beverage quality.

As previously mentioned, the presence of the deformable portion 10A of the wall 10 is a preferred feature of the invention.

At least one outlet opening is provided in the bottom wall 9 for discharging the prepared beverage from the cartridge to a collecting unit and eventually to a final container (e.g. a cup or a glass).

According to present invention, bottom wall 9 of cartridge is provided with a plurality of dispensing outlets defined by fracture lines, or grooves, 15. In the shown figures the required outlets 14 are located at the periphery of the bottom wall 9; however (FIG. 6A) a single outlet 9B or a combination of central outlet means 9B and of peripherally located outlets 14 can be used for the purposes of the invention.

In order to open the one or more outlet openings (9B, 14) these portions of the bottom wall 9 are provided with projecting elements that, in the preferred embodiment shown, are integral with the opening portions 9B or 14 and are formed e.g. by a wedge-shaped part of said opening portions. In other words, the bottom wall 9, in correspondence of the portions 9B and 14 defined by fracture lines 15, extends externally to provide a projecting portion. To avoid portions 9B, 14 to fall into the beverage collecting unit, a retaining means is provided to secure said portions to the bottom wall 9 of the capsule. In the shown embodiment said retaining means is consisting in integral hinges 16; it is clear that the hinges are obtainable in any suitable way, e.g by shaping the corresponding internal portion of the bottom wall.

According to the present invention, the capsule outlet discharge portions 9B, 14 are opened by the combined action of a mechanical pressure imparted by a portion of the seat for the capsule of a collecting unit 17 (FIGS. 9-10B) and by the build-up of internal pressure within the cartridge.

If besides making use of the invention feature of mechanical pressure and build-up of internal pressure to open the outlets, the capsule is provided with the internal collapsable wall 10 as above discussed, the beverage preparation will involve two steps of building up internal pressure: a first step that leads to the deformation of portions 10A of circular wall 10 to open passage P, and a second step that will result in the opening of outlet portions 14 of bottom wall 9 of the invention cartridge.

Figure 6A:
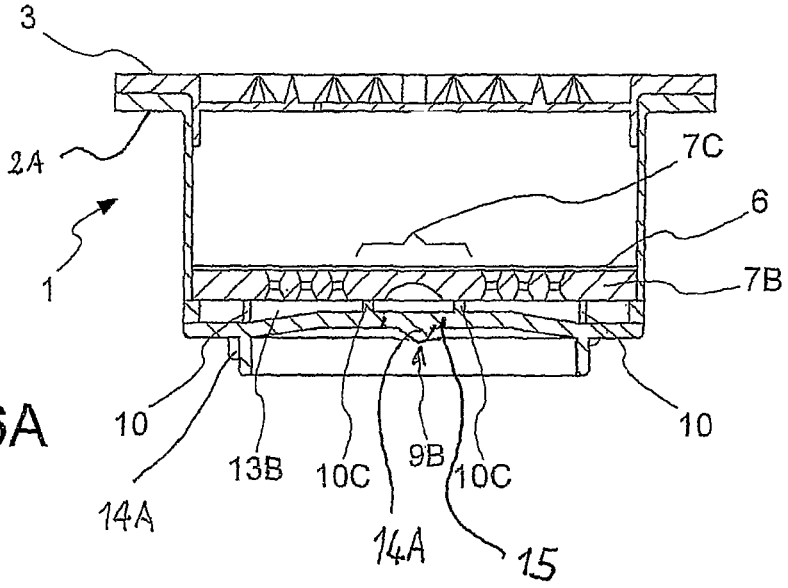
FIG. 6A is a sectional view of a further embodiment of the cartridge.

In FIG. 6A another embodiment is shown, where central area 7C of the filter support is greater than that of FIGS. 5 and 6. The bottom wall 9 is provided with a circular wall 10 as above disclosed and with a further circular wall 10C positioned around a central outlet means 9B. The passage here has wall 10C as the temporarily blocking element that is deformed by the beverage pressure. Outlet 9B is defined by grooves 15 and is provided with wedge-shaped portion 14A for its opening.

In the invention embodiments, the cartridge has at least one outlet opening that can be provided centrally or peripherally (as in the above discussed embodiment) or at both locations. It is stressed that the presence of the collapsible wall portions 10A or of wall 10C is a further feature possibly and optionally added (or possibly alternative) to the feature of the presence of projecting portions on the outlet openings or in correspondence thereof.

In the present embodiment, the water will initially enter the cartridge through a plurality of holes provided in top portion 3, prepare a beverage by brewing or dissolving the beverage product in chamber 12 and flow through holes 11 into chamber 13 (and open the blocked passage(s) P defined by walls 10A and 10B, if present). Once the beverage inside the cartridge has reached a sufficient pressure, outlets 9B and 14 are opened.

The one or more outlet portions 9B, 14 of the bottom wall 9 are provided with a groove 15 that defines the portion of the wall that will open to let out the beverage. The opening of outlets 14 is carried out in part with an external element that pushes the portions of bottom wall 9 that correspond to the outlet opening 9B and 14 towards the interior of the cartridge. This external element is in the form of a portion of a collecting unit 17 for the beverage, as shown in FIGS. 9-10B and 13-14. To open outlets 9B, 14 by a combination of external and internal pressures (a mechanical pressure externally and a pressurized water internally), a protruding element has to be present in order to apply the required forces on the outlet portions. As previously mentioned, this is preferably obtained by providing protrusions 14A on the cartridge or on the external element, i.e. the collecting unit, or on both.

As shown in the figures, outlet openings 9B and 14 are preferably provided with a projecting portion 14A that, in the preferred embodiment shown, is integral with the outlet opening portions 9B and 14. The vice versa embodiment contemplates the presence of corresponding projections on the collecting unit for the cartridge. As a matter of fact, the protrusions could be located on the bottom wall 9 adjacent to grooves 15 but outside outlets 9B or 14 so as to concentrate the cut forces on the grooves and have the outlets open from inside outside; however the previously disclosed embodiment with protrusions integral to the outlets is highly preferred for easyness of functioning, reliability and cleanliness of the apparatus.

The projecting portions 14A are preferably shaped so as to concentrate the deformation stresses on a part of the groove 15 and make it easier to open the outlets; a preferred shape of the projecting portion is the wedge shape shown in the figures. In other words, the bottom wall 9 in correspondence of the portions 14 defined by grooves 15, extends externally to provide projecting, wedge-shaped, portions 14A.

Figure 9:
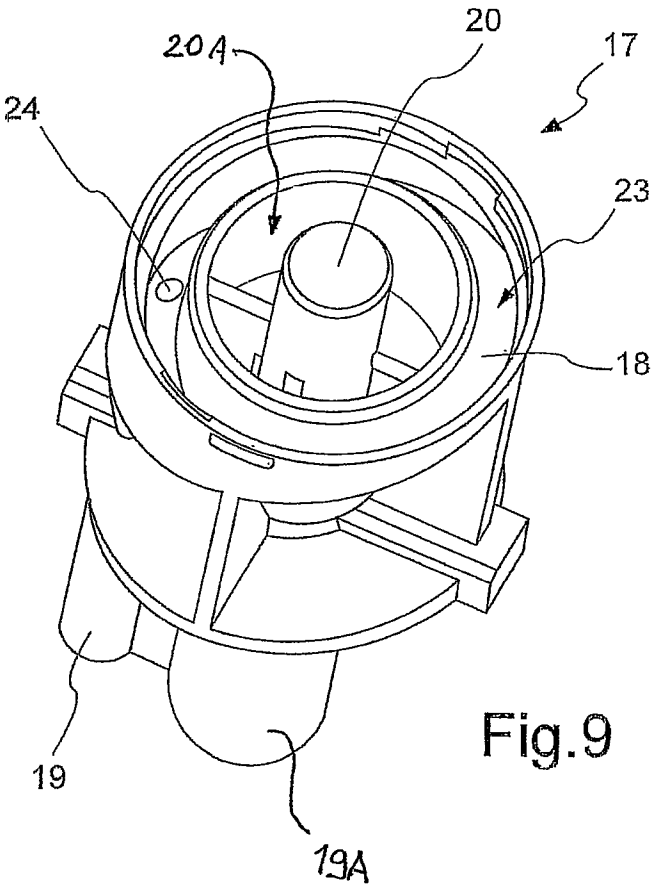
FIG. 9 is a schematic perspective view of a plunger and collecting device for the embodiment of FIGS. 1-6.
Figure 10:
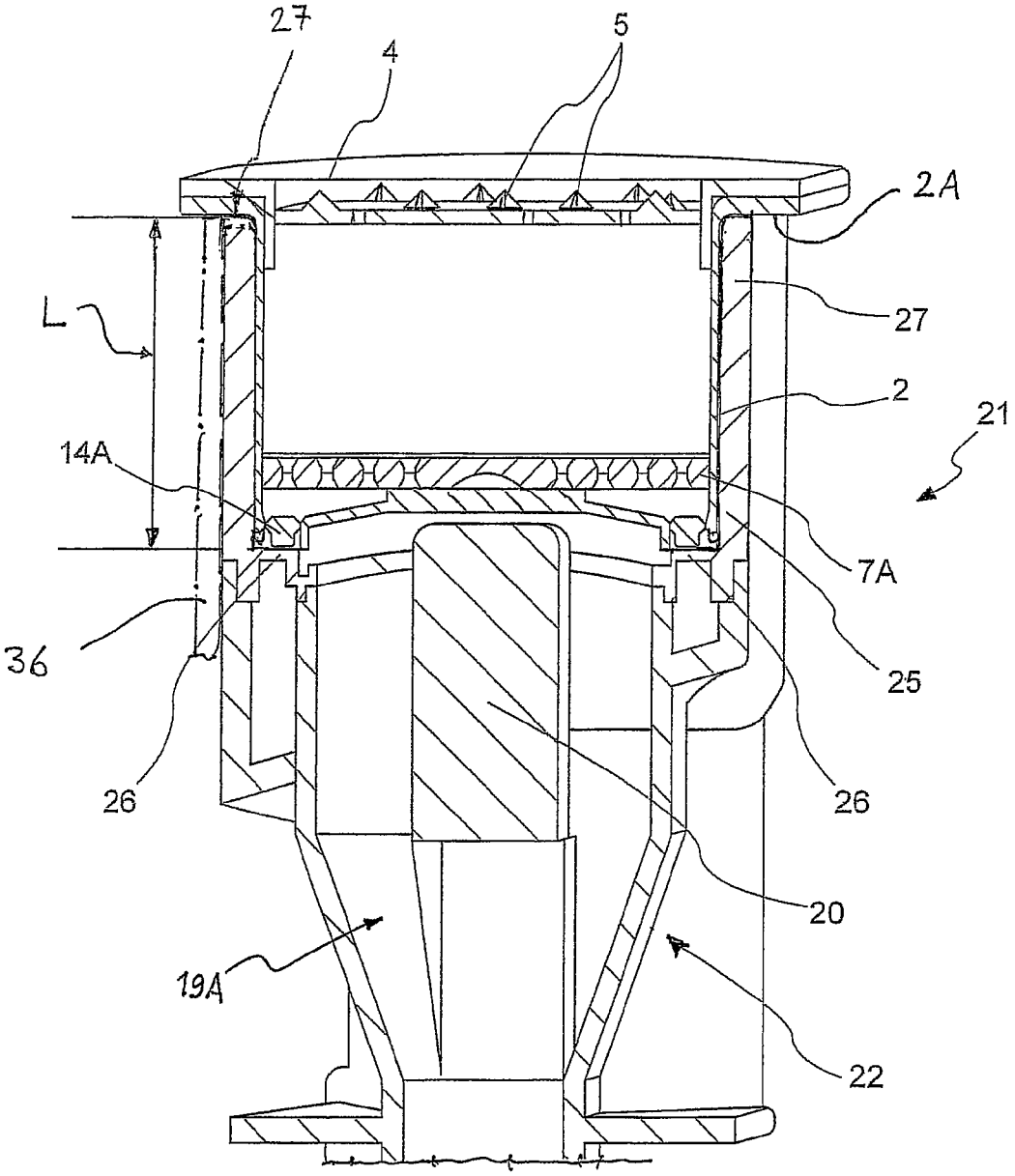
FIG. 10 is a sectional view of the capsule of FIG. 1 and a plunger and collecting device.
Figure 10A:
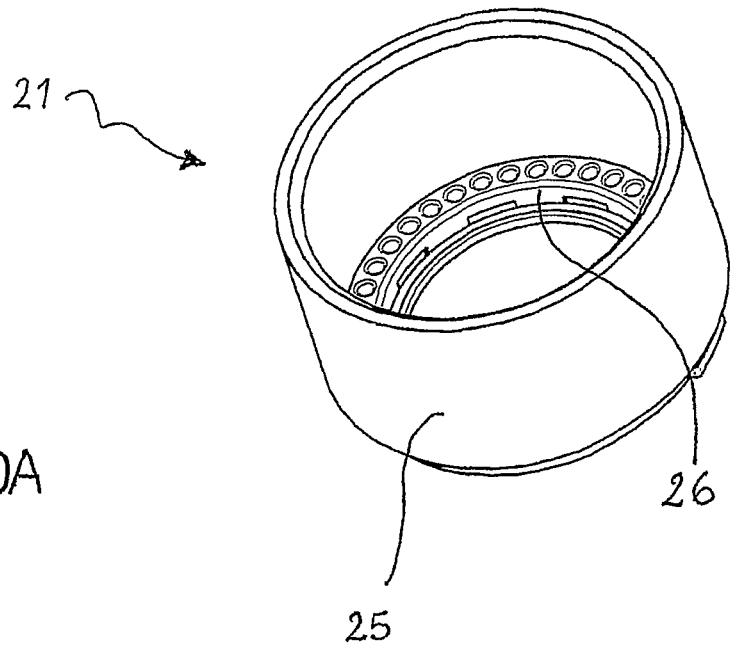
FIGS. 10A and 10Bb are a perspective and a sectional view of the upper portion of the collecting device of FIG. 9.
Figure 10B:
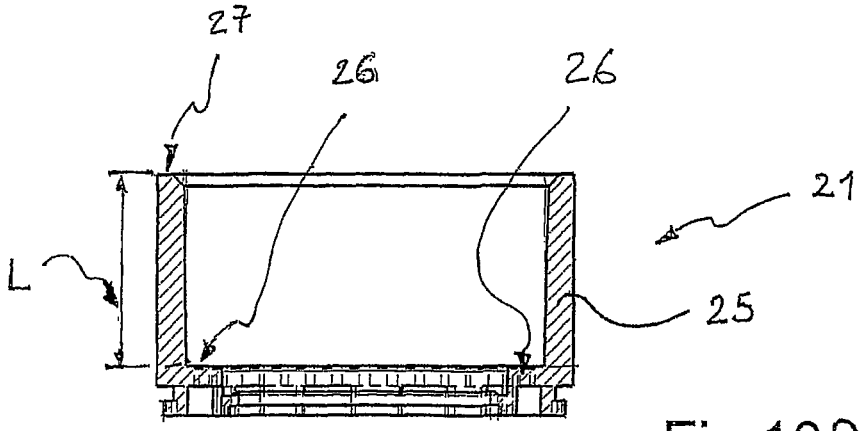

With reference to FIGS. 9-10B, a beverage collecting unit 17 according to the invention is shown. This unit is provided with an upper part 21 that houses the cartridge and with a lower part 22 that comprises plunger means and at least one duct or similar means to dispense the beverage to a final beverage container such as a cup or further beverage collecting means (not shown). Part 21 is coupled to part 22 in any suitable known way, e.g. by gluing, welding or mechanically, e.g. with a bayonet lock.

The lower portion 22 of collecting and dispensing means comprises a circular collecting chamber 23 coaxially arranged around a central piston 20 and a central collecting chamber 20A, and one or more dispensing ducts to direct the beverage to a cup.

In the embodiment disclosed by the figures, embodiment here shown only as an example, circular chamber 23 has a slanted bottom, i.e. a bottom wall 18 that is lining on a plane that is angled to the horizontal plane of unit 17. Chamber 23 is used to dispense coffee and bottom wall 18 directs the collected beverage to an outlet hole 24 that is connected to dispensing duct 19. Chamber 20A is connected to duct 19A and is used to dispense beverages obtained from soluble products such as chocolates or cappuccino, or the milk portion of a cappuccino, while the coffee portion is obtained by another part of the cartridge. In other embodiments according to the invention, only one collecting chamber is provided.

The upper part 21 of the collecting device 17 (FIGS. 10, 10A and 10B) is provided with lateral vertical walls 25 and with a bottom annular and horizontal wall 26, perforated, that is positioned above collecting chamber 23. Horizontal annular wall 26 supports the protruding portions 14A of the annular outlets 14, central piston 20 supports protrusion 14A of outlet 9B, if present (FIG. 6A), or supports the central part of cartridge bottom wall 9 to prevent it from being deformed outside when no central outlet is present (FIG. 10).

The length L of wall 25 extending between horizontal wall 26 and end portion 27 of said wall 25 is less than the sum of the length L1 of the vertical wall 2 of the cartridge (where L1 goes from the lower surface of flange 2A to the bottom end of the wall, FIG. 4) plus the length L2 of the part 14A of outlet means 14 protruding below wall 2 (FIG. 4), i.e. L<L1+L2. Preferably, the value of L is greater than that of L1 (L>L1).

As schematically shown in FIG. 10, this results in the fact that at least the part of bottom wall 9 that is adjacent to outlets 14 (or 9B) and protrusions 14A is not in contact with the supporting means i.e. the perforated circular wall or flange 26, but, rather, that below at least said section of wall 9 sufficient room is provided to allow a movement of said wall. An external metal element can be present to house the collecting unit 17, when this is made of plastics and may not withstand the forces acting on the cartridge. In this case, the top edge of the metal housing element 36 (as shown in dotted lines on the left part of FIG. 10) will contact the flange 2A of the cartridge and length L will have to take into consideration the additional length between edge 27 of the element 21 and edge of metal housing element 36.

In other words, if housing element 36 is present, the length of wall 25 of element 21 is such that edge 27 is slightly lower than the edge of element 36 and the flange 2A impinges on element 36 (dotted lines in left part of FIG. 10).

In this embodiment, length L is therefore the distance between perforated wall 26 and top edge of element 36.

Figure 7:
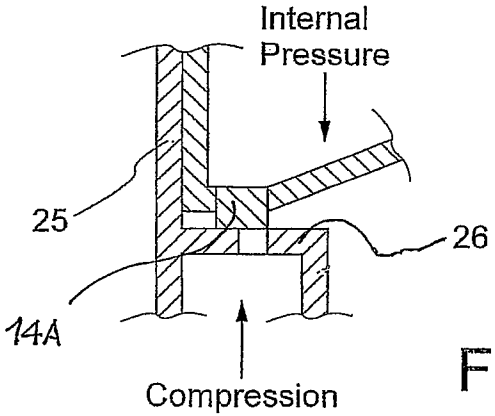
FIG. 7 is a schematic sectional view of a cartridge in a combined mechanical/pressure opening step.

In any case of the difference in above mentioned lengths L, L1 and L2 is such that when the cartridge is housed in collecting element 17 and is compressed against end 27 of wall 25 (or end of element 36) to provide the required sealing before feeding water to the cartridge, the wall 26 impinges on portions 14A of outlets 14 and pushes them upwards, i.e. towards the top of the cartridge, probably with other areas of the cartridge. In this condition, that is also shown schematically in FIG. 7, the outlet means are not opened, yet, and the grooves 15 are still intact or substantially intact. In other words, the outlet means 14 (and 9B) can withstand the compression force exerted on them by the beverage collecting element, when the cartridge is located in the collecting unit and compressed by the apparatus in the step prior to water feeding to the cartridge, i.e. the step immediately before starting the water pump of the dispensing machine.

At this step, water has not been fed to the cartridge.

Once then water feeding step is started, the pressure within the cartridge increases because there is no outlet for the water fed to the cartridge. The pressure formed within the cartridge by the liquid applies a force to the lateral and bottom cartridge walls; because the bottom wall is spaced from the circular wall 26 of upper portion 21 of the collecting unit, it can be moved downwards. Therefore, the internal pressure of the cartridge forces the bottom wall 9 downward, towards perforated circular wall 26 and piston 20 (see FIG. 10).

Figure 8:
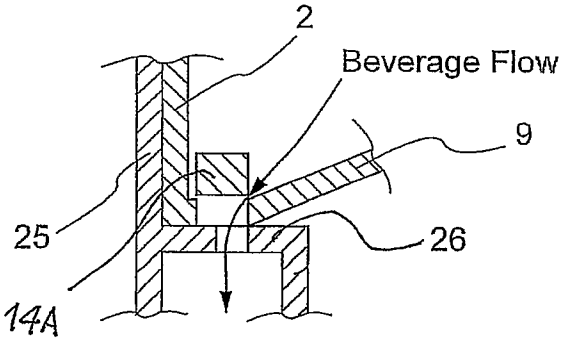
FIG. 8 is a view of the embodiment of FIG. 7 at the following step.

The combined action of mechanical pressure of wall 26 on elements 14A and of the pressure within the cartridge on bottom wall 9, results in the breaking of the grooves, i.e. of the breakable lines, 15 and in the opening of outlet means 14 and/or 9B (FIG. 8).

Figure 11:
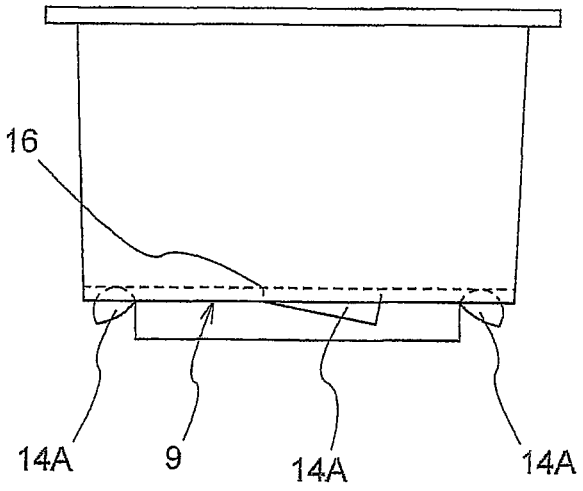
FIG. 11 is a side view of the capsule of FIG. 1 in a first configuration.
Figure 12:
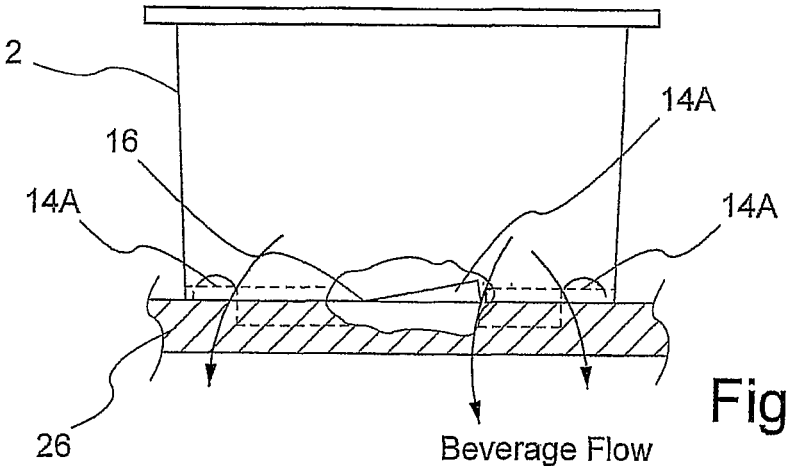
FIG. 12 is a side view of the capsule of FIG. 1 in a second configuration

FIGS. 11 and 12 respectively show a cartridge before its opening and after being opened by the surface 26 of collecting device 17. When the cartridge is closed and ready to be used (FIG. 11) the portions 14A project from the bottom 9 of the cartridge 1 while sealing the outlet openings 14. When the cartridge undergoes a beverage dispensing cycle (FIG. 12) the wall; or flange 26 of unit 17 is biased against the projecting portions 14A to achieve, together with the pressure built up inside the cartridge by the water fed into it, partial separation of said portions 14A from the cartridge bottom 9, this causing opening of the outlets 14 (FIGS. 11 and 12). The wall 26 acts as a plunger and pushes the projecting portions 14 towards the inside of the cartridge until the surface 26 of the plunger abuts the bottom 9 of the cartridge. The projecting portions 14A rotate about the respective hinge 16 and enter the cartridge 1. In this way the outlets 14 are opened at least partially. The arrows in FIG. 12 show a possible path for the beverage flow through the outlets 14.

The above remarks apply mutatis mutandis to the embodiment providing also, or alternatively, a centrally located outlet opening 9B with a projecting portion 14A (FIG. 6A). In this case, as above mentioned, the projecting portion 14A of outlet 9B will act in the same way as the projecting portions of outlets 14. The embodiment shown in FIGS. 9 and 10 is provided with piston 20, centrally located to the wall 9 and spaced from it, so as to provide a support for the wall 9, during the pressurization step, and the required room under it; in the case of a centrally located outlet 9B, the bottom wall of the cartridge will be correspondingly modified and the piston top side will be long enough to open the corresponding outlet 9B with the same procedure as above disclosed. To help in letting the beverage out from outlet 9B, the adjacent area of bottom wall 9 is preferably provided with grooves or ridges for beverage flow.

The invention thus provides a path that includes a throttling along the beverage path, said throttling comprising the outlet opening that is obtained after breaking grooves 15 and the narrow passage between the opened outlets 14, 9B and the collecting unit perforated flange (or wall) 26' and/or piston 20.

The opening time for the cartridge, i.e. the length of the time between starting the water pumping and the opening of the outlets can be adjusted ceteris paribus by appropriate selection of the cartridge material and design of the cartridge and of the collecting unit 17.

Materials suitable for the invention capsule are PP omo and copolymers, and HDPE (High Density Polyethylene), with tensile strength within the range of 23 to 29 MPa for copolymers, and 32-36 for omopolymers. Preferred materials are mixtures of copolymers and omopolymers of polypropylene in a mixture omo/copolymers within the range of 30/70 to 50/50, said mixture having a tensile strength within the range of 27 to 31 MPa.

Projecting portions 14A have a maximum height (i.e. they protrude from bottom wall 9) within the range of 1.2 to 4.2 mm and preferably of 2.0-3.0 mm. The value of the mechanical deformation, i.e. of the deformation, or displacement, of the cartridge outlets in the pre-water feeding step preferably is within the range of 0.5-2.5 mm, depending on the plastic material.

In a preferred embodiment, the wedge portion 14A maximum height L2 is 2.5 mm and the difference (L1+L2)−L is 1.7 mm. This means that when compressed before feeding water to the cartridges, the protrusions are deformed but are not pushed completely inside the cartridge: there are about 0.8 mm of the protrusions 14A still protruding from the bottom wall of the cartridge, i.e. the outlets are not open, yet. With this deformation value, the outlets are still closed when water is fed to the cartridge and will break open only after a sufficient pressure is reached; in the shown embodiment the pressure required to open the cartridge is 6-8 bar and the outlet will open by breaking along grooves 15 after about 3 seconds.

The above discussed embodiment is particularly useful for preparing fresh coffee from ground coffee, but the same features can be used with other products for preparing beverages.

Figure 13:
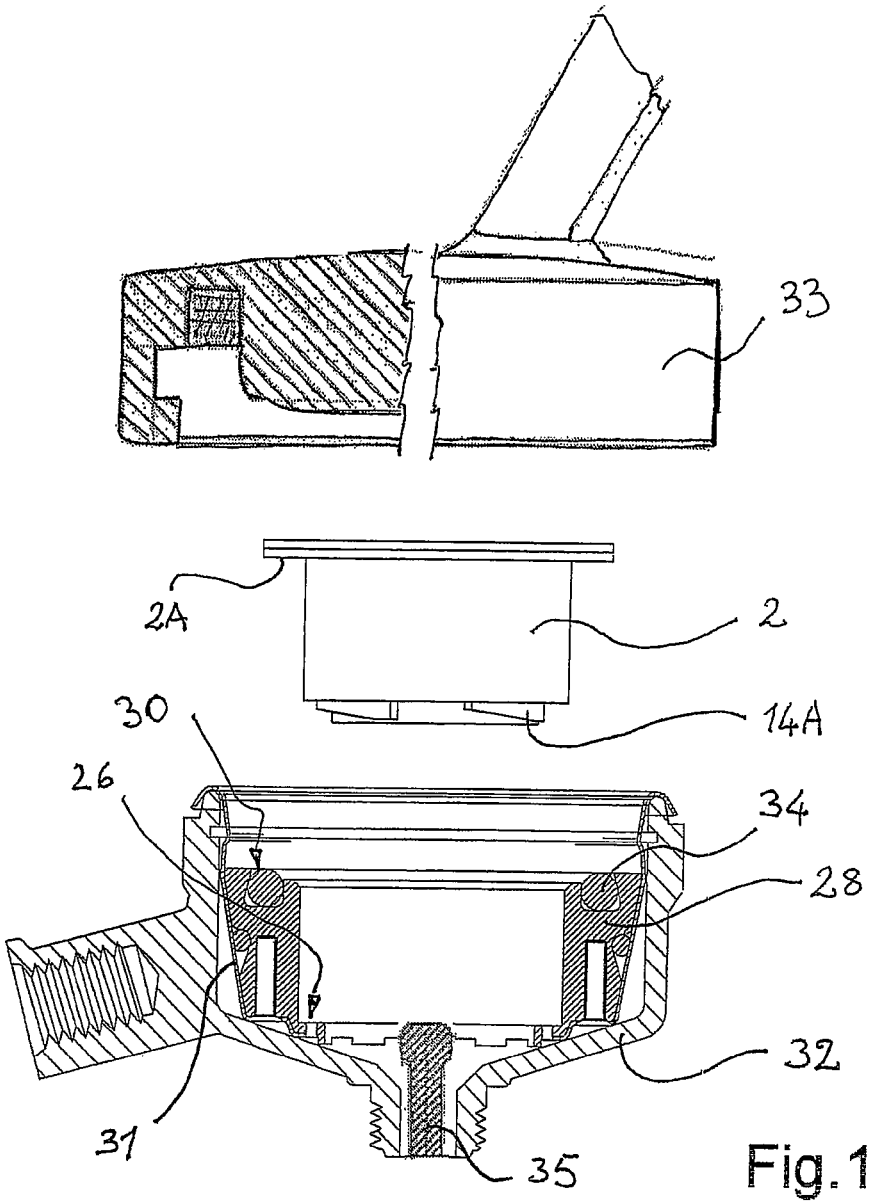
FIGS. 13-14 show a further embodiment of a collecting device according to the present invention.
Figure 14:
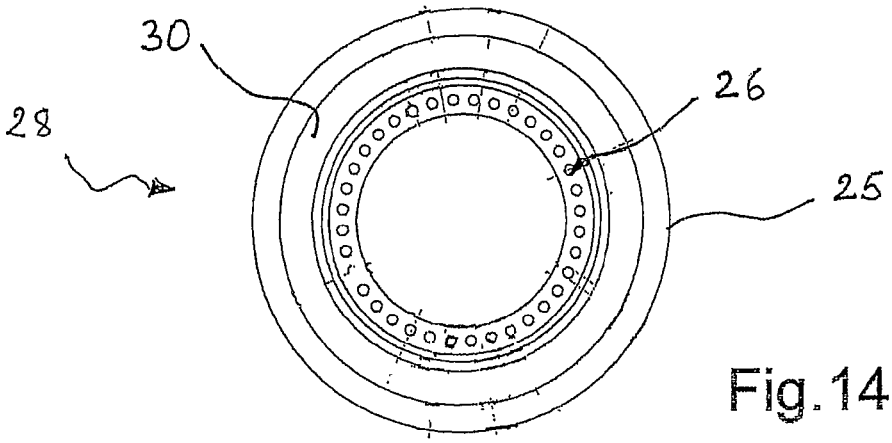

FIGS. 13-14 show a further embodiment of a collecting device according to the present invention; in this device the previously disclosed upper part 21 of the collecting unit was externally modified into cartridge housing 28, to be inserted in a collecting unit 32 used in manually operated machines of the type used in bars. The basic structure of element 28 is still the same as element 21 of collecting unit shown in FIGS. 9 and 10.

As shown, the cartridge housing 28 is provided with a lower flange having a perforated wall 26 and with two seats 29 and 30 for housing two gaskets. The element 28 is housed in an adapter 31 that is positioned in a collecting unit 32 that is to be used with the water feeder 33 of a commercially available coffee machine.

A rod or similar element 35 is provided at the bottom of collecting unit 32; this rod has the same purpose of piston 20 in collecting unit 17, i.e. it gives a support to the bottom wall 9 of the cartridge so as to avoid that it is deformed outwards when pressurized hot water is fed to the cartridge, letting the beverage flow out of unit 32.

When the cartridge has been inserted in the housing 28 in collecting unit 32 and unit 32 has been inserted in water feeder 33 (FIG. 14) the cartridge is compressed to deform the wedge shaped portions 14A toward the inside of the cartridge, without opening the outlets 14. In a preferred embodiment for this use the difference (L1+L2)−L is 1.7 mm, as per above mentioned automatic machine embodiment using collecting unit 17. Again, with this deformation value, the outlet are still closed before feeding water to the cartridge and will break open only after a sufficient pressure is reached; in the shown embodiment the pressure required to open the cartridge is 6-8 bar and the outlet will open by breaking along grooves 15 after about 3 seconds.

The invention will now be further discussed with reference to the following examples.

Example 1 (Reference)

Preparation of Espresso Coffee

A conventional cartridge, i.e. with outlet means already opened before feeding water to the cartridge, containing 7.0 g of roasted ground coffee, was used to prepare an espresso coffee. The particle size of at least the 90% of said coffee is less than 600 μm. The cartridge underwent a complete cycle and 35 ml of coffee were dispensed in 25 seconds. The hydraulic circuit of the dispensing machine made use a vibration pump (Hulka) and the time lapse between the water pump start and the beverage exit (beverage delay) has been measured. Moreover the amount of dry residue coffee has been measured in the resulting beverage, after water evaporation, as a percentage of the initial ground coffee weight. The results are as follows:

| | |
|---|---|
| beverage exit delay | 1.5 s |
| dry residue | 23%. |

Example 2

Preparation of Espresso Coffee

A cartridge according to the present invention, provided with four outlets peripherically located to the capsule has been used, containing 7.0 g of roasted ground coffee. The particle size of at least the 90% of said coffee is less than 600 μm. The cartridge was made of polypropylene omo/copolymers mixture in a 40/60 ratio with a tensile strength of 28 MPa. The difference (L1+L2)−L was 1.7 mm with a residual deformation to undergo of 0.8 mm; the opening pressure, as measured in the hydraulic circuit, above the cartridge, was 6 bar. The cartridge underwent a complete dispensing cycle and 35 ml of coffee were dispensed in 25 seconds. The hydraulic circuit of the dispensing machine made use of a vibration pump and the time lapse between the water pump start and the beverage exit (beverage delay) was measured. The amount of dry residue coffee has been measured in the resulting beverage, after water evaporation, in terms of percentage of the initial ground coffee weight. The results are as follows:

| | |
|---|---|
| beverage exit delay | 4 s |
| dry residue | 30%. |

The dry residue coffee in the second example is greater than the dry residue coffee in the first example. In other words the cartridge according to the present invention allows for a better extraction of the coffee with respect to traditional cartridges at the same conditions. This data is consistent with the better characteristics of the obtained beverage.

The invention claimed is:

1. A cartridge for a beverage dispensing apparatus, comprising:

water inlet means for feeding water to said cartridge to prepare a beverage as a prepared beverage and build up pressure within said cartridge, and beverage outlet means for discharging said beverage from said cartridge, said outlet means being provided in a bottom wall of the cartridge, the beverage outlet means being defined by grooves recessed into the bottom wall and the beverage outlet means including projecting portions attached to the bottom wall of the cartridge and encircled by the grooves, each of the grooves that encircle the projecting portions are positioned in a different sub-section of a periphery of the bottom wall, wherein in a first position, the projecting portions extend outwardly from the bottom wall to an exterior of the cartridge in a first direction to block an opening in the beverage outlet means to prevent the beverage from being discharged through the opening, in a second position, the projecting portions are moved toward an interior of the cartridge to be positioned inwardly from the first position for the beverage to be discharged from the cartridge through the opening in the beverage outlet means, and the projection portions are configured to move from the first position to the second position in response to combined external pressure from the beverage dispensing apparatus and the pressure built UP within the cartridge from the water fed to the cartridge.

2. The cartridge according to claim 1, wherein at least one of said projecting portions is shaped to concentrate compression stresses in one area of the outlet means to open said beverage outlet means.

3. The cartridge according to claim 1, wherein said cartridge is made of a material that has a tensile strength within a range of 27 to 31 MPa.

4. The cartridge according to claim 1, further comprising a passage for said beverage to flow through located internally to said cartridge and blocking means for at least partially blocking said passage until a pressure is reached within said cartridge which acts on said blocking means whereby said beverage can flow through said passage and reach said beverage outlet means.

5. The cartridge according to claim 4, wherein said blocking means is deformable or rupturable under pressure of the prepared beverage.

6. The cartridge according to claim 5, wherein said blocking means is a plastically deformable element integral with said cartridge or a portion thereof.

7. The cartridge according to claim 4, wherein said cartridge includes the bottom wall and an internal wall and said blocking means is a wall extending between said bottom wall and said internal wall.

8. The cartridge according to claim 1, in combination with a beverage preparing chamber to feed the water to the cartridge to prepare said beverage and build up the pressure within said cartridge and to dispense the prepared beverage from beverage outlet means, wherein:

a) at least a portion of the cartridge bottom wall, including at least part of said outlet means, is configured to receive a force before the water is fed to the cartridge, the force being directed towards an interior of said cartridge, said force being less than a force required to open said outlet means in said cartridge bottom wall;

b) said cartridge, including said cartridge bottom wall, is configured to experience an increase in the pressure from the water while maintaining said force until obtaining an outlet opening for dispensing the said beverage.

9. The cartridge according to claim 8, wherein said portion of the cartridge bottom wall consists of said beverage outlet means, said outlet means comprising the grooves.

10. The cartridge according to claim 8, wherein said portion of the cartridge bottom wall comprises a portion adjacent to said beverage outlet means.

11. The cartridge according to claim 8, wherein said beverage preparing chamber is configured to feed said beverage to at least one passage located within said cartridge and a block element at least partially blocking said at least one passage until reaching a pressure sufficient to deform or break said block element within said cartridge to form an unblocked passage through which the beverage is let to flow to said beverage outlet means, thereby extending a brewing time for preparing said beverage.

12. The cartridge according to claim 11, wherein said block element comprises a deformable wall that deforms upon reaching sufficient pressure to let said beverage flow to said beverage outlet means.

13. The cartridge according to claim 12, wherein said deformable wall is configured and arranged so that deformation of said deformable wall results in a throttling element located internally to said cartridge.

14. The cartridge according to claim 1, in combination with a beverage collecting unit to dispense the beverage from said cartridge to a beverage container, wherein said beverage collecting unit comprises means to apply a force to a portion of the bottom wall of said cartridge to deform said bottom wall without breaking said grooves when said cartridge is housed within said collecting unit and before the pressure from the water is built up within said cartridge.

15. The cartridge according to claim 14, wherein said force applying means is provided in correspondence with at least said outlet means.

16. The cartridge according to claim 1, wherein the bottom wall of the cartridge includes a rim that extends further outwardly in the first direction than the projecting portions in the first position and the second position.

17. The cartridge according to claim 1, wherein the beverage outlet means includes a central opening in the bottom wall, the central opening being encircled by a central groove and including a central projecting element.

18. The cartridge according to claim 17, wherein, in the first position, the central projecting element extends outwardly from the bottom wall of the cartridge in the first direction.

19. A cartridge for a beverage dispensing apparatus, comprising:

a top portion including a sealing foil and a plurality of pointed elements to puncture the sealing foil to let water into the cartridge to prepare a beverage and build up pressure within the cartridge, and a beverage outlet to discharge the beverage from said cartridge, the beverage outlet being provided in a bottom wall of the cartridge, the beverage outlet being defined by grooves recessed into the bottom wall and the beverage outlet including projecting portions attached to the bottom wall of the cartridge and encircled by the grooves, each of the grooves that encircle the projecting portions are positioned in a different sub-section of a periphery of the bottom wall, wherein in a first position, the projecting portions extend outwardly in a first direction from the bottom wall to an exterior of the cartridge to block an opening in the beverage outlet, and in a second position, the projecting portions are moved toward an interior of the cartridge to be positioned inwardly from the first position for the beverage to be discharged from the opening in the beverage outlet.

20. The cartridge according to claim 19, wherein the bottom wall of the cartridge includes a rim that extends further outwardly in the first direction than the projecting portions in the first position and the second position.

21. The cartridge according to claim 19, wherein the beverage outlet means includes a central opening in the bottom wall, the central opening being encircled by a central groove and including a central projecting element.

22. The cartridge according to claim 21, wherein, in the first position, the central projecting element extends outwardly from the bottom wall of the cartridge in the first direction.

23. A cartridge for a beverage dispensing apparatus, comprising:

water inlet means for feeding water to said cartridge to prepare a beverage as a prepared beverage and build up pressure within said cartridge, and beverage outlet means for discharging said beverage from said cartridge, said outlet means being provided in a bottom wall of the cartridge, the beverage outlet means being defined by grooves recessed into the bottom wall and the beverage outlet means including projecting portions encircled by the grooves, wherein in a first position, the projecting portions extend outwardly from the bottom wall to an exterior of the cartridge in a first direction to block an opening in the beverage outlet means to prevent the beverage from being discharged through the opening, in a second position, the projecting portions are moved toward an interior of the cartridge to be positioned inwardly from the first position for the beverage to be discharged from the cartridge through the opening in the beverage outlet mean, and at least one of said projecting portions includes a wedge-shaped part to concentrate compression stresses in one area of the outlet means to open said beverage outlet means, and when in the first position, a narrow portion of the wedge-shaped part extends outwardly from the bottom wall of the cartridge and a wide portion of the wedge-shaped part is positioned in the opening to block the opening in the beverage outlet means.

24. The cartridge according to claim 23, wherein the beverage outlet means includes a central opening in the bottom wall, the central opening being encircled by a central groove and including a central projecting element.

25. The cartridge according to claim 24, wherein, in the first position, the central projecting element extends outwardly from the bottom wall of the cartridge in the first direction.

* * * * *